US005544966A

United States Patent [19]

Pagliaro et al.

[11] Patent Number: 5,544,966

[45] Date of Patent: Aug. 13, 1996

[54] PRINTER WITH MULTIFUNCTIONAL PAPER HANDLING CAPABILITY

[75] Inventors: Vittorio Pagliaro; Paolo Urso, both of Milan; Lorenzo Caro, Varese, all of Italy

[73] Assignee: Bull HN Information Systems Italia S.p.A., Torino, Italy

[21] Appl. No.: 399,813

[22] Filed: Mar. 7, 1995

[30] Foreign Application Priority Data

Mar. 11, 1994 [EP] European Pat. Off. ..... 94830106

[51] Int. Cl.[6] ..... B41J 11/30

[52] U.S. Cl. ..... 400/616; 400/608.2; 400/692

[58] Field of Search ..... 400/605, 606, 400/616.611, 616.1, 616.2, 616.3, 692, 608.1, 608.2

[56] References Cited

U.S. PATENT DOCUMENTS

| | | | |
|---|---|---|---|
| 4,440,516 | 4/1984 | Rosenthal et al. | 400/616.2 |
| 4,934,849 | 6/1990 | Yosuoka | 400/616 |
| 5,100,251 | 3/1992 | Yasuoka | 400/605 |
| 5,183,348 | 2/1993 | Kato | 400/616.2 |

*Primary Examiner*—Christopher A. Bennett

*Attorney, Agent, or Firm*—Rosen, Dainow & Jacobs Limited Liability Partnership

[57] ABSTRACT

Printer with multifunctional paper handling capability having a lambda rear front structure section, a first (P1) paper path for paper front feeding by a first removable tractor set (21), a second paper path (P2) for cut sheet frontal feeding by driving rollers (22) and a third paper path (P3) for paper rear feeding by the first tractor set or a second tractor set (41), all the manual paper loading operations being performable from the printer front having a dihedral recess.

10 Claims, 7 Drawing Sheets

PRINTER WITH MULTIFUNCTIONAL PAPER HANDLING CAPABILITY

BACKGROUND OF THE INVENTION

The present invention relates to a printer having multifunctional paper (more generally printing supports) handling capability.

The evolving customer needs are imposing as a requirement for heavy duty office printers the capability of interchangeably handling different kinds of continuous forms, together with cut sheets manually or automatically fed to the printer.

In some office applications the user may be allowed to select a particular kind of printing support among a plurality without unloading the previously used supports from the printer and without having the task of loading the printer with the selected printing support at each selection.

DESCRIPTION OF THE PRIOR ART

To this purpose the parking function is known and used since a long time, to park continuous forms, fed to a printing station by push tractors sets.

A push tractor pair, continuously engages a continuous form with side perforations (usually a multiple copy continuous form) and positively drives the form to a printing station and away from it, depending on the movement direction imposed to the tractors.

Thus a continuous form, permanently engaged in the tractor pair can be fed to the printing station printed at same extent. The printed portion can be teared off, manually or automatically, downstream of the printing station.

Subsequently, the remaining portion of the continuous form may be retracted away from the printing station and upstream of it, still being retained by the tractor pair, which necessary must be located upstream of the printing station.

The continuous form remains parked in the tractor pair, without reloading need, ready for further use on demand but free the printing station to which a different kind of printing support can be fed.

By providing a plurality of push tractor sets, different continuous forms can be alternatively used, one at a time, the other or the others being parked.

By concurrently parking all the continuous forms, cut sheets may be fed, manually or automatically to the printing station.

Cut sheets need not to be parked, because they are picked up, fed to the printing station, printed and discharged from the printer one at a time leaving the printing station free to receive any kind of printing support for subsequent printing operations.

In some application there is also the need to concurrently print on a continuous form while printing on a different kind of printing support. An example is the concurrent printing of a cash journal (a continuous form) and an account card (a cut sheet).

In other applications there is also a demand for the handling of heavy multiple copy continuous forms which are difficult to push to the printing station, cause frequent jamming and are subject to tearing of the perforated edge.

They are preferably pulled towards the printing station by pull action tractor sets located downstream of the printing station. In several cases tractor pairs are preferably used, a push pair upstream of the printing station and a pull pair downstream to distribute the tractor force among a plurality of cooperating tractor sets.

In the past these different requirements have been met with different products because of the problems involved in attempting to reconcile them in a single equipment.

For example printers have been offered having as a basic feature the capability of handling a continuous form by push tractors, with parking function and cut sheets manually fed.

As optional functionalities, mutually exclusive each to the other, a second pair of push tractors, or an automatic form feed device, with selection from a plurality of bins has been offered.

The problems in combining more extended functionalities results from operability contraints and from the difficulty in merging a plurality of differing paper feeding paths into a single paper path at the printing station, still ensuring a reliable paper feeding.

Moreover the provision of options or add-ons which must be coupled to a basic equipment for cooperation therewith, requires a design of the basic equipment tailored to the several options and provided with mechanisms and control functions of the options which increase the cost of the basic equipment and penalize the user needing the basic equipment only.

For instance printers have been proposed having a first removable push tractor set which can be installed in two positions so as to feed a continuous form along a first path, drawing the form from the bottom of the equipment, or along a second path, drawing the form from the rear of the equipment.

A second tractor set, identical to the first one can be installed so that two different continuous forms can be fed in mutually exclusive way, without need to move the tractor set in either one or the other of the two position.

With a single equipment different customer needs are met, and a user requiring the handling of a single continuous form does not need the second tractor set.

However the printer must have distinct motor means for the two tractor sets or, if common motors means are provided, independently operated clutches for selectively driving one of the two tractor set or none of them are required.

This requirement arises from the need of handling cut sheets with the same motor means and independently of the continuous form handling.

The additional cost of separate motor means or two independently operated clutches is imposed to the equipment even if the printer, in its basic configuration, has only one tractor set installed therein.

Moreover, the installation of a second tractor set in such known printers is mutually exclusive with the installation of other optional equipments, such as automatic cut-sheet feeders.

SUMMARY OF THE INVENTION

The present invention provides a multifunctional printers overcoming these limitation and meeting a plurality of customer needs with a basic equipment, to which non mutually exclusive add-ons can be coupled, the basic equipment being not overburdened by the cost of expensive coupling and control devices of the add-ons.

In one aspect of the present invention there is provided as a basic equipment a printer having a paper feed system comprising a removable tractor set, which may be positioned in either a first one or a second of two positions to feed a continuous form from a first or a second paper path to a printing station in push mode.

The tractor set is provided with an inherent clutch, electrically controlled from the printer for controlling the tractor set coupling to a paper feed driving motor in the printer and allowing continuous form selection and parking, A third paper path is provided allowing cut sheet manual feeding.

When in the second position, the tractor set, may be further pivoted in a third position and a reverse coupling established with the paper feed driving motor: in this position the tractor set is aligned substantially in straight line with the paper path in output from the printing station, and operates in pull mode, particularly suitable for feeding relatively rigid continuous form, whose bending is to be avoided.

In a further aspect of the present invention the printer is provided with a removable additional second tractor set, identical to the first one, so that the printer can select and feed one of two continuous forms from two different paths and cut sheets from the third path.

Alternative configuration and functionality is offered by the installation of the second tractor in the second position, by pivoting it in the third position. With the second tractor set in this third position, the two tractor set operate in push-pull mode respectively on the same continuous form, allowing for the handling of heavy multiple copy forms, with possible overlaying of cut-sheets.

Overlaying is also possible in the other configurations because cut sheets are fed from the front of the printer and can be easily handled by the operator with no interference with continuous form concurrently fed at the rear of the cut sheet.

According to a further aspect of the invention a double protection is provided against unintentional driving action reversal by subjecting reversal to actuation of a reversal mechanism independent of and additional to pivoting.

Coextensive with the second tractor set a first single or multiple bin automatic sheet feeder can be coupled to the printer, providing automatic cut sheet feeding in addition and coextensive with manual cut sheet feeding.

In high speed serial printers, as the one of the present invention, the printing head reciprocation at the printing station, along a printing line, with fast accelerations/decelerations, causes remarkable vibrations of the printer frame, in the reciprocation direction, transferred to the whole printer.

According to a further aspect of the present invention a substantive vibration damping is provided by mounting the printer frame on a base through resilient pads compression stressed in the reciprocation direction.

Further the frame is effectively decoupled from the base, and from the cover elements of the printer, which are fixed to the base, not to the frame so that noise deadening is obtained too.

In a further aspect of the present invention the operability of the printer by the user is enhanced by providing a printer structural shape, which in rear-front section view has substantially the form of the greek letter λ and obviously of the mirror image thereof.

The front, corresponding to the left concave side of the lambda letter, has a dihedral recess open at its ends, which provides broad space for easy access to a tractor set for paper loading and/or tractor set removal and further houses a pivotable supporting plate for easing cut sheet manual insertion from the front.

The tractor set is located at the lower left leg of the lambda shape.

The tractor set can be moved in a second position extending the lambda section structure in an X shaped structure, which offers easy access to the tractor set in this second position from either the front or the rear of the printer.

In this case the tractor set is located at the upper right arm of the X shape.

The frame rear, corresponding to the right side of the X section shape provides broad space for coupling an automatic form feed module to the printer from the rear, thus rendering the automatic cut sheet feeding coextensive with the manual cut sheet front feeding and the related overlay printing capability.

Still coextensive with the previous capabilities, an automatic form feeder from the front may be provided, as well as a cut sheet stacker located above the printer.

BRIEF DESCRIPTION OF THE DRAWINGS

The features and the advantages of the invention will result more clearly from the following description of a preferred form of embodiment and from the enclosed drawings where.

DETAILED DESCRIPTION

Figure 1:
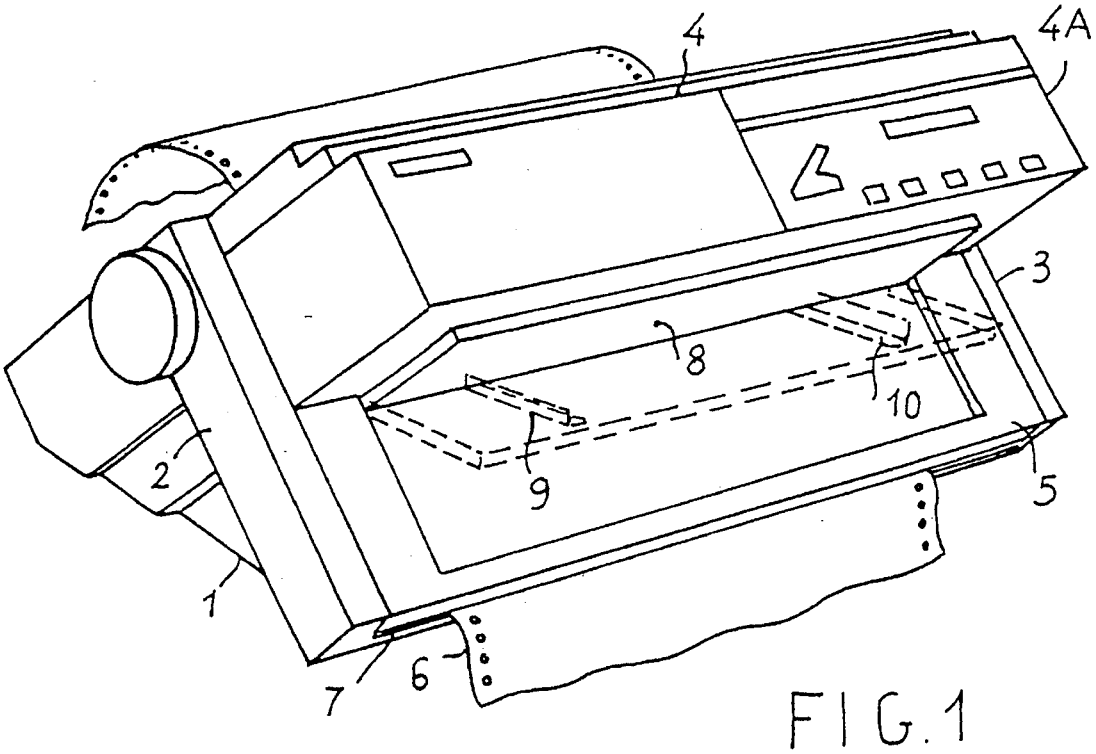
FIG. 1 is a perspective front-side view of a printer having multifunctional paper handling capabilities in accordance with the present invention.

Referring to FIG. 1 a printer in accordance with the invention comprises a substantially prismatic body having a base 1 with two substantially triangular side plates 2, 3, housing a mechanical frame, a power supply and electronic control circuits of the printer, not shown.

A removable cover 4, in form of a rectangular parallelepiped connects to a slanted edge of the side plates 2, 3 and partly upperly closes the front of the printer body.

A second removable plate cover 5 closes the remaining portion of the body front and masks a removable tractor set, not shown, housed between the side plates 2, 3.

A free dihedral recess with an opening of 90° is formed between cover 4 and cover 5, allowing for easy operation of the tractor set for paper loading or tractor set removal/insertion. For operation on the tractor set removal of cover 5 suffices.

Figure 2:
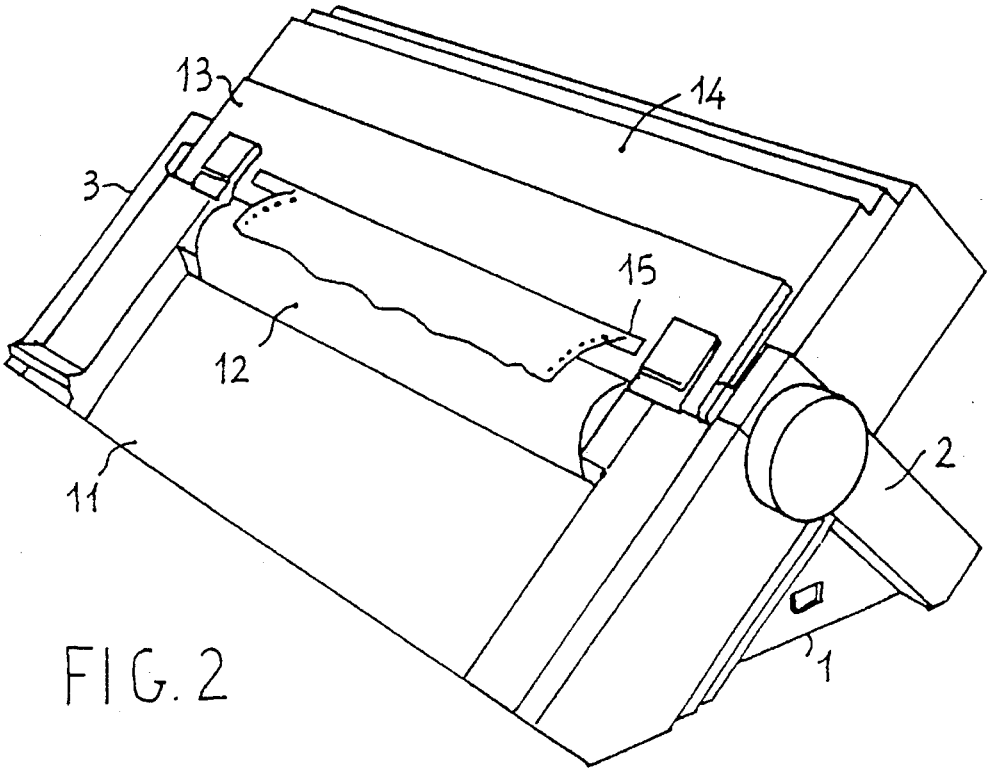
FIG. 2 is a perspective rear-side view of the printer of FIG. 1.

A continuous form 6 loaded in the tractor set, flows inside the body, through a slot 7 formed between cover 5 and base 1 and is output from the printer rear (FIG. 2).

A cut sheet supporting plate 8 is hinged on the lower face of cover 4 at the dihedral recess apex, and can be moved from the shown position in which it contacts the lower face of cover 4 to an open position, shown in dotted lines, in which it is substantially horizontal, for providing support to a cut sheet to be manually inserted into the printer.

The supporting plate 8 is provided with position adjustable rules 9, 10 allowing precise alignment of the cut sheet, which enters the printer body through a slot formed between the cover 4 and the supporting plate 8 leading to a pair of driving pinch rollers.

The cover 4 comprises on the front side an operator panel 4A having display units and push buttons for printer control by an operator.

FIG. 2 shows in perspective rear-side view the printer of FIG. 1.

The rear of the printer body is closed by a plurality of removable elongated panels 11, 12, 13, 14, providing access respectively to the electronic equipment of the printer, (panel 11) to paper driving mechanisms (panel 12) to a paper output path (panel 13) and to the printing mechanism (panel 14) for easy replacement of an ink ribbon cartridge.

All the panels are slanted as to the base of an angle, about 45° and directly extend from the base to the printer front.

Panel 13 has integral therewith an output slot 15 allowing the printed form (cut sheet or continuous form) to leave the printer body.

The output slots 15 may also be formed as a gap provided between panel 12 and panel 13.

Removal of panel 12 allows for attachment to the printer frame of removable tractors set, or an automatic sheet feeder (with single or multiple bins) or both.

Removal of panel 13 allows for attachment to the printer frame of a cut sheet stacker, which may be further provided with a cutting unit.

From FIGS. 1 and 2 it is readily apparent that the printer is very easily operable and that all devices requiring manual intervention by the operator can be easily accessed and are under visual control by the operator standing in front of or on the rear of the printer, without compelling him to take undersired and tiring postures.

This ergonomic advantage further conciles with superior multifunctional paper handling capabilities of the printer, which appear more clearly from FIGS. 3 to 8.

Figure 3:
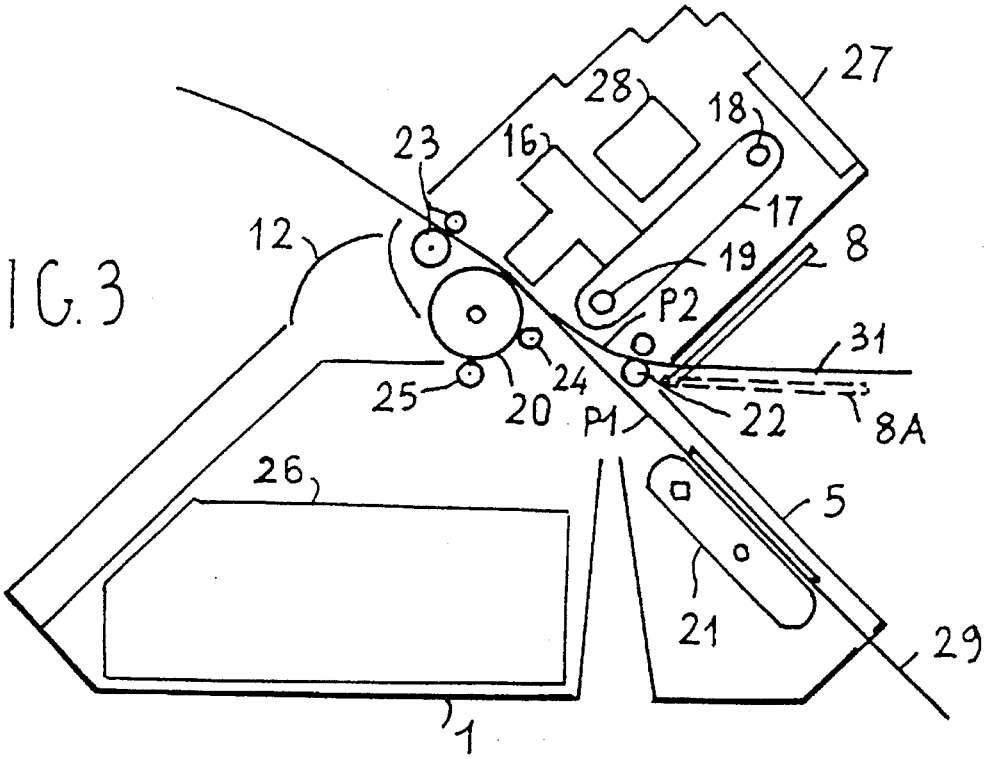
FIG. 3 shows the printer of FIG. 1 in rear-front schematic section view with a first tractor set arranged in a first position.

Turning now to FIG. 3 there is schematically illustrated in front/rear section view, various internal parts of the printer in its basic configuration, e.g. without optional add-ons.

A printing head 16 is mounted on a carriage 17 reciprocable on guiding bars 18, 19 and faces to a rotating platen 20. A removable tractor set 21 is housed in the frontal portion of the base 1.

A first pair of pinch rollers 22 and a second pair of pinch rollers 23 are respectively provided upstream and downstream of the platen 20, as well as a plurality of friction rollers 24, 25 contacting the platen. The normal forward paper feeding and printing direction corresponds to the platen rotatiog counterclockwise.

Electronic boards 26 are housed in the rear portion of the base 1. An ink ribbon cartridge 28 is arranged to interpose an ink ribbon-portion between the platen 20 and printing elements of the print head 16.

Motor means, not shown and controlled by the electronic boards 26 drive in rotation the platen 20.

Continuous gearing not shown is provided between platen 20, at least one of the rollers of pinch rollers 22, 23 and the tractor set 21.

Clutch means, not shown and integral to the tractor set provide selective engaging/disengaging of the tractor set to/from the gearing, under control of the electronic boards 26, which in turn responds to commands input from operator panel 27, or from a data processing system through a connection line, not shown.

The lambda section shape of the printer, offers enhanced operability as to the prior art printer.

A continuous form 29 may be easily loaded from the front, into the tractor set 21, by temporarily removing the cover 5.

The tractor set then provides positive pushing of the continuous form along a first substantially straight path P1, nearly 45° slanted up to the platen 20, where the form interposes between platen and print head 16.

The form then exits from the printer, through the pinch driving rollers 23 and the opening 15 on the top rear of the printer (FIG. 2).

By reverse feeding of the continuous form 29, in known manner, the form can be parked in the tractor set 29 and cut sheets can be manually inserted into the printer along a second path P2.

To this purpose the supporting plate 8 can be pivoted in the horizontal position shown by dotted line as 8A.

A cut sheet 31 can be laid down on the plate 8 A and manually fed so as to be pinched by driving rollers 22, which push the cut sheet along path P2 up to the platen for printing.

The pinch driving rollers 22 are located, between the first paper path and the print head 9, so that the continuous form, along path P1 does not interfere with the cut sheet feeding from the front along path P2.

Continuous form 29 and cut sheets 31 can be alternately fed, or simultaneously fed so that by overlaying the cut sheet to the form they are printed in a single printing operation.

Figure 4:
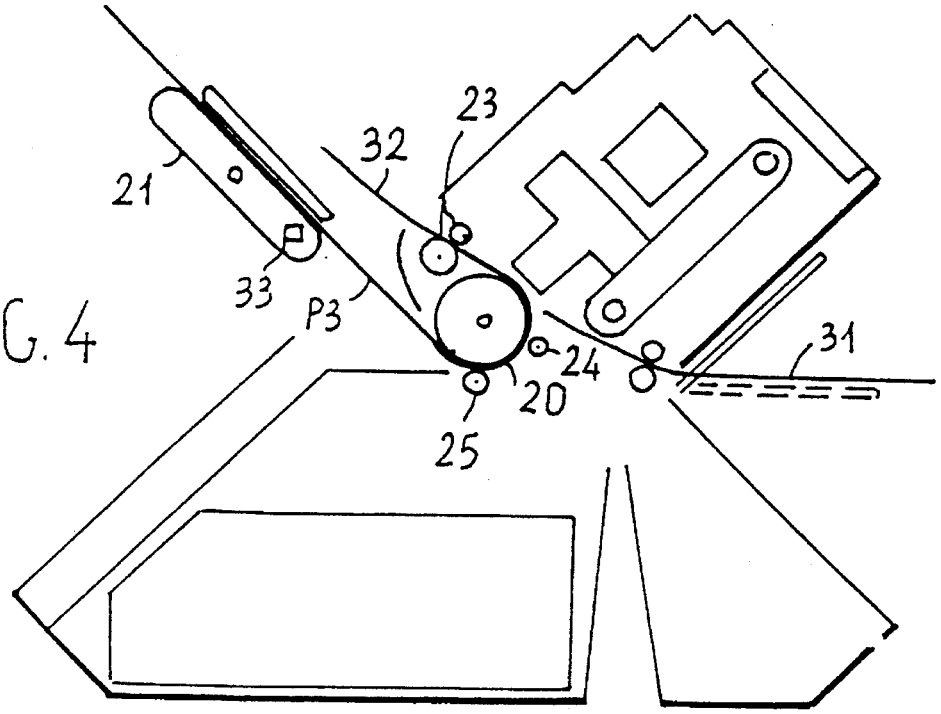
FIG. 4 shows the printer of FIG. 1 in rear-front schematic section view, with a tractor set arranged in a second position.

If continuous form feeding from the front is undesired, the operator by simply opening the cover 12 (FIGS. 1 and 3) may remove the tractor set 21 from the front and install it on the rear side of the printer as shown in FIG. 4.

In this case a continuous form 32 is pushed by the tractor set 21 towards the platen 20, along a third path P3 and is returned, by rotation of the platen 20 to the pinch rollers 23 and to the rear of the printer.

Even in this case tractor loading can be easily performed and visually monitored by an operator standing at will on the front or on the rear of the equipment.

Cut sheets 31 can be manually fed from the front, in overlay or alternance with the continuous form 32 as already discussed. As it will be more extensively described, the tractor set 21 comprises two parts pivotable each to the other around a tractor driving shaft 33 and the coupling of the shaft 33 to the mechanical transmission of the printer is performed through a manually operated motion reversal mechanism.

In this way the movement direction of the tractors relative to the platen can be reversed and the tractors can work as pull tractors or push tractors.

Figure 5:
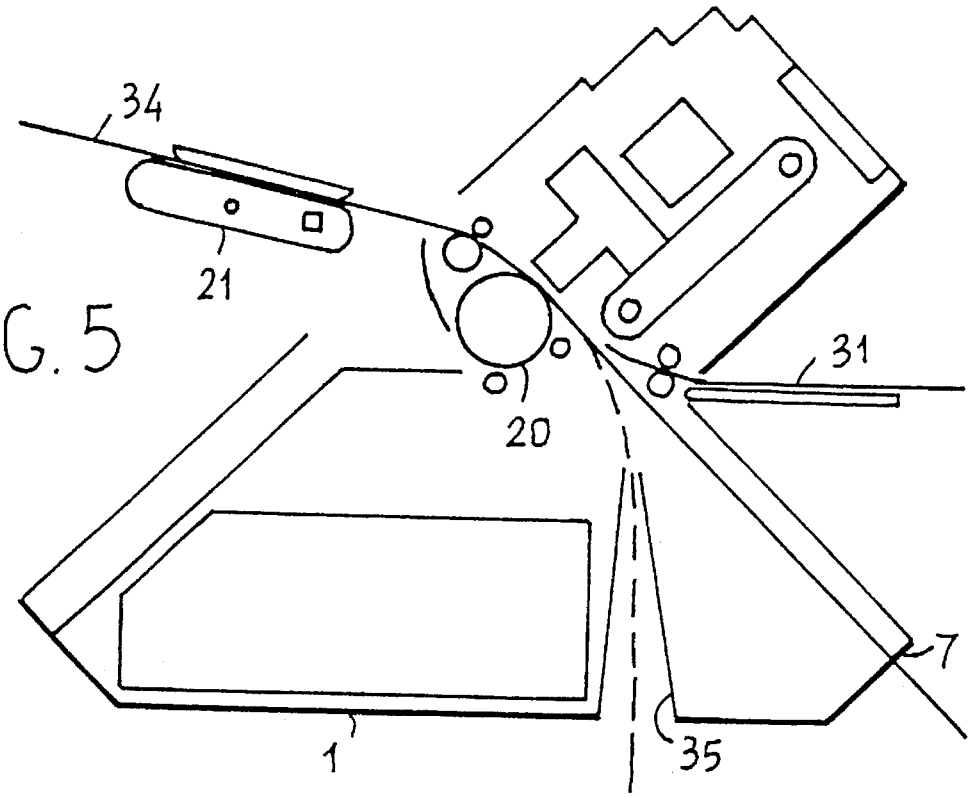
FIG. 5 shows the printer of FIG. 1 in rear-front section view, with a tractor set arranged in a second position and pivoted in a third position.

As shown in FIG. 5, by pivoting the tractor set 21, installed on the rear of the printer, and by reversing the movement direction, the tractor set 21 may operate in pull mode pulling a continuous form 34, from a front input 7 towards the platen 20 in a nearly straight path particularly suitable for continuous forms, where bending has to be avoided.

Cut sheets 31 can also be fed in overlay mode or, by unloading the continuous form 34, in alternative thereto.

As it will be more readily apparent from the following the base 1 of the printer is provided with a bottom loading hopper 35 which allows a continuous form to be inserted from the bottom and through the base 1.

In this case, the printer will have to be installed on a stand designed for paper bottom feed, rather than on a conventional working desk.

The basic printer configuration may be enriched with options which broaden the functionalities of the printer.

Figure 6:
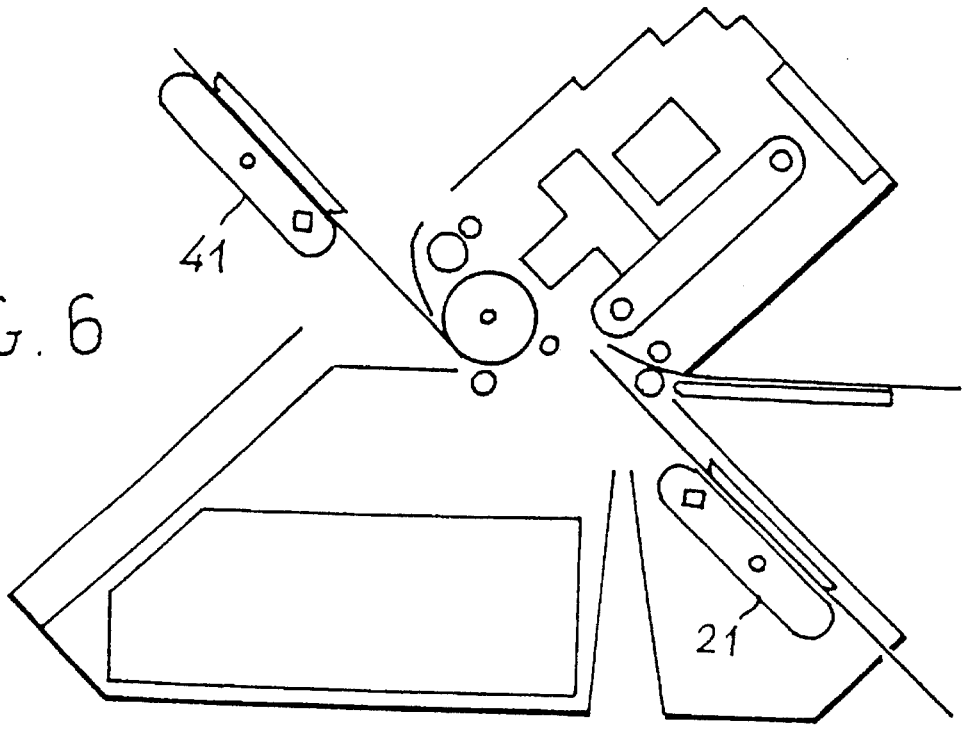
FIG. 6 shows the printer of FIG. 1 in rear-front schematic section view, with two tractor sets respectively arranged in a first and a second position.

As shown in FIG. 6, by providing two tractor sets 21, 41 respectively installed on the front and the rear of the printer, two different continuous forms can be alternately fed from two different paths, one of the two being parked.

By parking both the continuous forms cut sheets can be fed from the front.

Overlaying of the cut sheets, fed from the front, with either one or the other of the two continuous forms is also possible.

Figure 7:
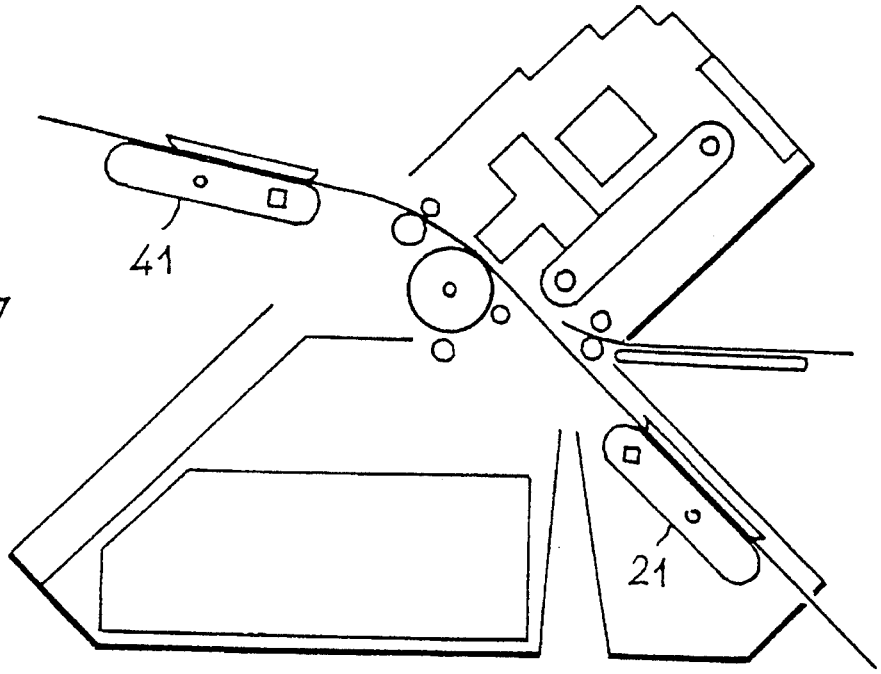
FIG. 7 shows the printer of FIG. 1 in rear-front schematic section view, with a first tractor set arranged in a first position and a second tractor set arranged in a second position and pivoted in a third position.

Further as shown in FIG. 7 by pivoting the tractor set 41 and reversing its paper feeding direction, a printer is obtained where two tractor sets cooperate in push-pull mode to feed a continuous form, at the same time allowing manual cut sheet feeding from the front, in overlay with the continuous form, or alternance thereto.

It is to be noted that alternative printing on cut sheets and continuous form does not require in this case continuous form unloading and reloading.

After manual or automatic tear off of the printed portion of the continuous form, the continuous form can be parked in the push tractor set 21 for printing cut sheets, then advanced again to the pull tractor set 41, where the continuous form is engaged with the tractor pins by simply opening of the tractors or even in automatic way with a suitable design of the tractors, providing paper invitation.

FIGS. 4, 5, 6, 7 show that installation of a tractor set on the rear of the printer extend its structure to form a body, whose section is schematically an X, the tractor set being installed in a position symmetrical to the front installation position relative to the platen.

What may appear a merely aesthetical design choice is on the contrary the solution of the problems imposed by a printer which must be easily operated, in ergonomic way, at the same time assuring coexistance of several functional add-ons and their operability.

The dihedral recess on the printer front, corresponding the right side of the lambda or X printer sectional shape allows for easy loading of both continuous forms and cut sheets.

The dihedral recess formed on the rear of the printer when a tractor set is installed on the rear, allows for the coupling to the printer of automatic sheet feeders without interference with the tractor set.

Manual loading operations are further easier because the dihedral recess being open at its ends, the environment diffused light is not prevented from lighting the recess even if the operator stands in front of the printer, very close thereto.

Figure 8:
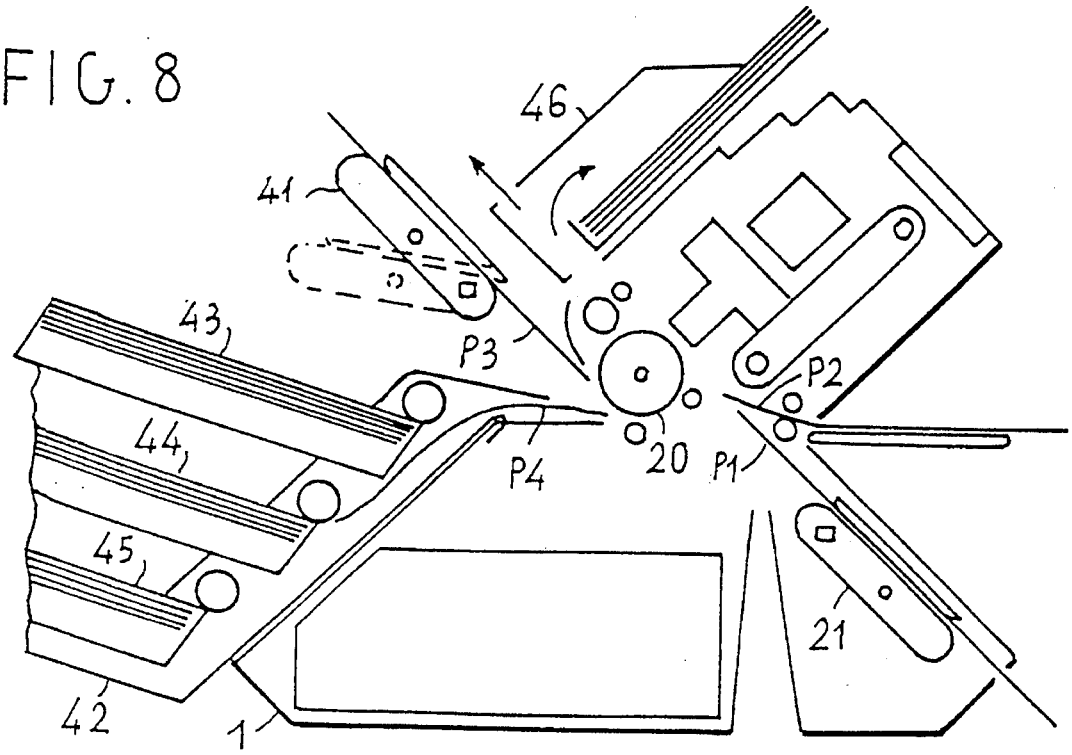
FIG. 8 shows the printer of FIG. 1 in rear-front schematic section view, equipped with a plurality of options.

As shown in FIG. 8, an automatic sheet feeder 42, conventional in design, and having for instance three bins 43, 44, 45 may be coupled to the rear of the printer, by hooking to the printer frame and resting by gravity on the slanted surface of the rear cover 11.

The sheet feeder 42 is provided with its own paper feeding rollers, actuated independently of those of the printer.

No mechanical coupling of the rollers is required with the mechanical printer gearing.

Cut sheets picked up by the automatic sheet feeder are conveyed along a path P4 merging with path P3 at the platen 20.

Further in the dihedral formed between the rear tractor set and the upper rear cover 14, a conventional paper stacker 46 may be installed for selectively collecting and stacking cut sheets and allowing release of the continuous forms, when in use.

The stacker 46 may be installed coextensively with a tractor set on the rear and no interference with it.

Figure 9:
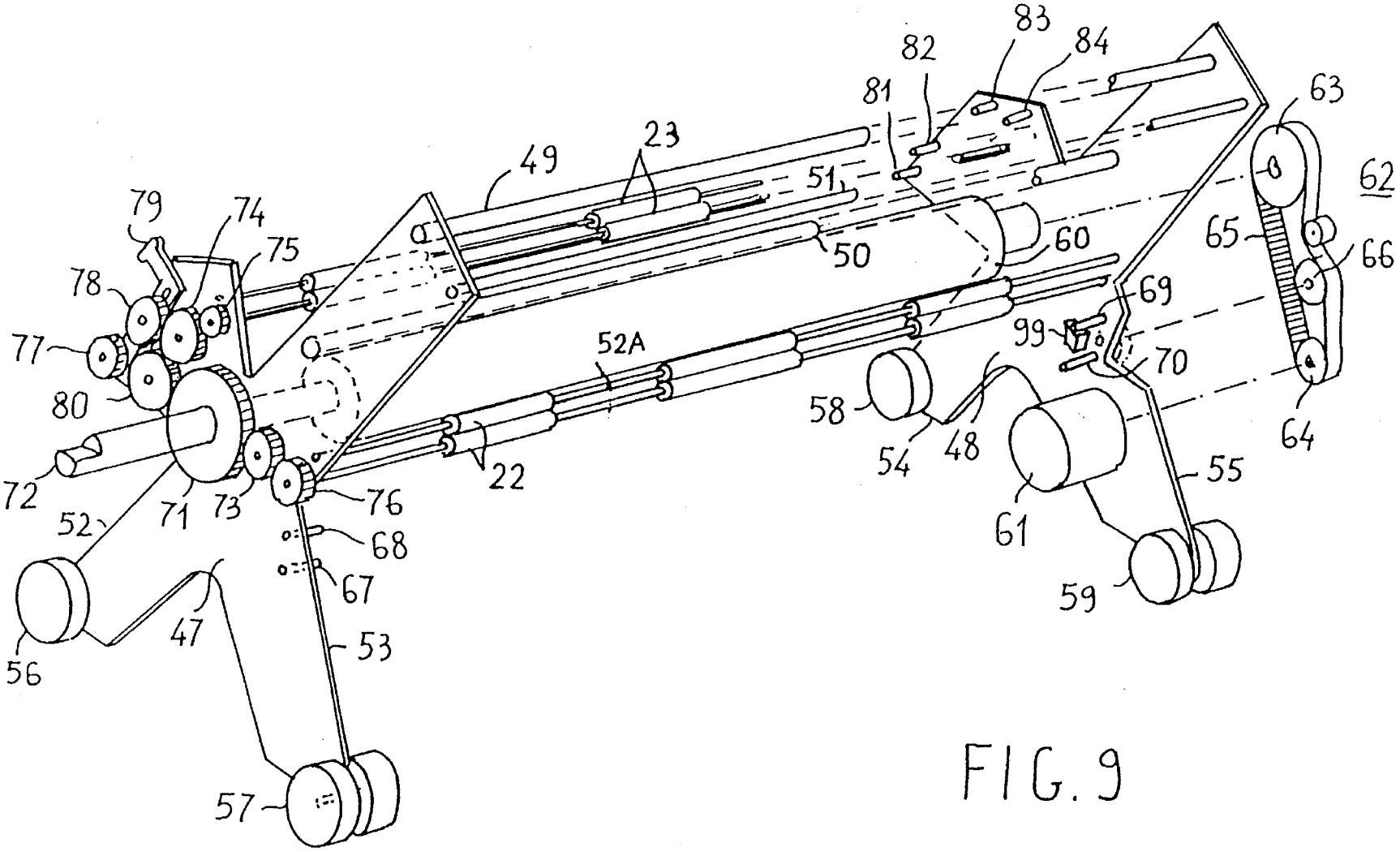
FIG. 9 shows in front-side perspective view the frame of a printer of FIG. 1.

FIG. 9, shows in more detail, in perspective, partially exploded view, the mechanical structure of the printer. The structure comprises a frame formed by two parallel side plates 47, 48 coupled together by a plurality of transverse rods 49, 50, 51.

Some of the rods may also perform other mechanical functions. For example rods 49, 50 are used as a guiding bars for the printer head carriage, not shown for a better intelligibility of the drawing.

Other rods may provide support to idle pressure roller of the pinch rollers pairs 22, 23 or to friction rollers 25, 24 (FIG. 3).

The side plates 47, 48 are shaped in form of a lambda with a shorter arm extending the lambda shape into an X.

The lower legs 52, 53, 54, 55 of the side plates are each provided with at least one resilient cylindrical pads 56, 57, 58, 59 fixed to the related leg by a pin perpendicular to the side plates and extending within the pad in alignment with the cylindrical pad axis.

As it will appear in the following the pads are housed in correspondingly shaped recesses of the printer base.

Since reciprocation of the printer carriage and the consequent accelerations/decelerations thereof are cause of substantive vibrations impressed to the frame in the direction perpendicular to the side plates, the pads so arranged are compression stressed and particularly effective in preventing the transfer of such vibrations to the printer base and the printer covers coupled thereto.

A cylindrical platen 60 is rotatably mounted between the side plates 47, 48, with a shaft extending outside plates 47, 48.

A motor 61, fixed to side plate 48 is coupled through gearing 62 (formed by gears 63, 64, and toothed belt 65) to the platen shaft. Positive driving is also provided by gearing 62 to a tractor set driving gear 66, journaled on a pin fixed to side plate 48.

The tractor set, not shown in FIG. 9 is fixed, on the printer front, to pins 67, 68, 69, 70 supported by side plates 47, 48 and coupling with corresponding fork mortises, provided in the tractor set.

On side plate 47 a similar gearing is provided for coupling the platen shaft 60 to a least one of the shafts of pinch rollers 22 and pinch rollers 23.

This gearing consists in a driving gear 71 splined on platen shaft 72 and engaged with and idle gear 73 in turn coupled to a gear 76 splinned on a shaft of pinch rollers 22.

Gear 71 is further engaged with an idle gear 80, in turn engaged with an idle gear 74, in turn engaged with a gear 75 splined to a shaft of pinch rollers 23.

Two idle gears 77, 78, axially slidable along respective supporting pins, respectively engage with the two gears 80,74.

Selective engagement of gears 77,78, in mutually exclusive way, is provided by a sliding element 79 inserted between side plate 77 and gears 77,78 and having a projection which selectively moves either gear 77 or gear 78 away from the side plate 47, disengaging either gear 77 or gear 78.

Side plates 47, 48 are provided with two pair of pins, such as 81, 82 on side plate 48 and two others, specular one on side plate 47, for mounting a tractor set in the rear frame position.

When a tractor set is installed in the rear frame positions a driving gear, mounted in the tractor set engages with both gears 77, 78 and depending on which of the gears 77, 78 is engaged with gear 80 or 74 respectively, rotates in the same direction of gear 71 or in the opposite one.

Further pins, such as 83, 84 on side plates 48, and corresponding pins, not shown, on side plate 47 provide hooking for a removable printed sheets stacker.

An electrical connector socket 99 is mounted to side plate 48, close to pins 69, 70 for providing electrical coupling to an electrical actuator, integral to the tractor set when the tractor set is installed in the front of the frame.

An identical electrical connector socked, not visible, is mounted on side plate 47 for providing electrical coupling to the electrical actuator integral to the tractor set, when the tractor set is intalled on the rear of the frame.

Indicatively this connector socket is located opposite to gears 77, 78 relative to side plate 47.

Figure 10:
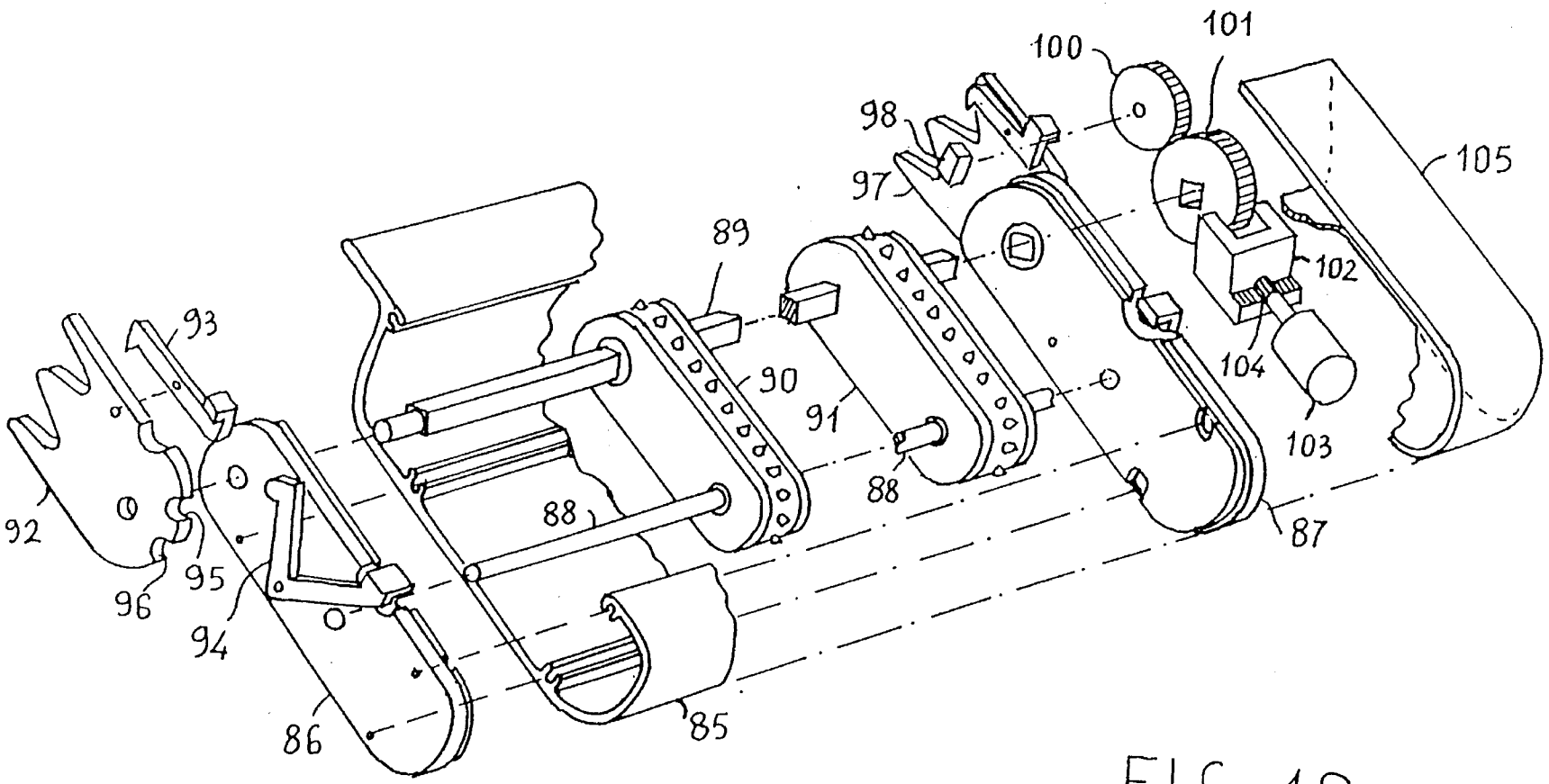
FIG. 10 shows in perspective exploded view a removable tractor set of the printer of FIG. 1.

Turning now to FIG. 10 there is shown in exploded perspective view a preferred embodiment of removable tractor set.

The tractor set comprises a frame 85, formed in light extruded section, closed at the ends by plugs 86, 87 preferably plastic molded. The plugs are fixed to the section by screws, not shown.

A guiding bar 88 extends between the plugs.

A driving shaft 89, extending parallel to guiding bar 88 is rotatably mounted, through suitable bushings, on the plugs 86, 87.

Two conventional tractors 90, 91 are slidably mounted on shaft 89 and guiding bar 88.

The driving shaft 89 extends through plug 86 to form a pivotal support for an extension arm 92 having a comb for coupling with the tractor set mounting pins of the frame, (such as 67, 68 and 81, 82 of FIG. 9).

Steady coupling of arm 92 and the pins is provided by a lever operated ratchet 93 pivotally mounted on arm 92.

The extension arm 92 is steady positioned as to plug 86 in one of two positions, by a lever operated ratched 94, pivotally mounted on plug 86 and cooperating with notches 95, 96 of the arm 92.

A like structure is provided at the other end of the tractor set frame, where an arm 97 is pivotally coupled to a plug 87.

Arm 97 is provided with an electrical plug 98, for electrical coupling with connection socket 99 (or the corresponding socket on side plate 47 of FIG. 9).

Further it supports an idle gear 100.

When the tractor set is installed on the printer front, gear 100 engages with gear 66 (FIG. 9).

When the tractor set is installed on the printer rear, gear 100 engages with both gears 77, 78.

Note however that gears 77, 78 are driven in mutually exclusive way.

A gear 101 is splined on shaft 89, coaxially slidable thereon so as to engage or disangage with gear 100, depending on its axial position.

The axial position of gear 101 in imposed by a fork 102 (or similar arrangement) slidably mounted on plug 87, provided to this purpose with a suitable rail not shown.

A motor 103, preferably a step motor, fixex to plug 87 moves the slidable fork 102, (hence the gear 101) to the required position through a gear-rack coupling 104.

A suitable cover 105 encloses gear 101, fork 102 and motor 103.

Similar protection may be provided to gear 100.

It is therefore clear that when the tractor set is installed on the printer front, and the motor 103 is drived (through the coupling of connectors 98, 99, obtained by simply hooking the tractor set to the frame pins), to engage gear 101 with gear 100, a continuous form can be fed by actuation of the paper feeding motor 61.

Concurrently with the tractor set, the platen 60 and the pinch rollers 22, 23 are driven.

If it is requested to feed a continuous form from the rear with a second rear installed tractor set or to manually feed a cut sheet, the motor 103 can be actuated to disengage gear 101 from gear 100.

Likewise if the tractor set is installed on the printer rear, gear 101 may be engaged or disengaged from gear 100, depending on operative requirements.

Moreover, by releasing ratchet 94 the tractor set may be pivoted as to arms 92, 97 so as to take one of the two positions shown in FIG. 6, 7 respectively.

Reversal of the tractor driving direction, which can operate in push mode or pull mode, is provided by actuation of the sliding element 79, requiring from the operator an operation additional and distinct from the tractor set pivoting.

Figure 11:
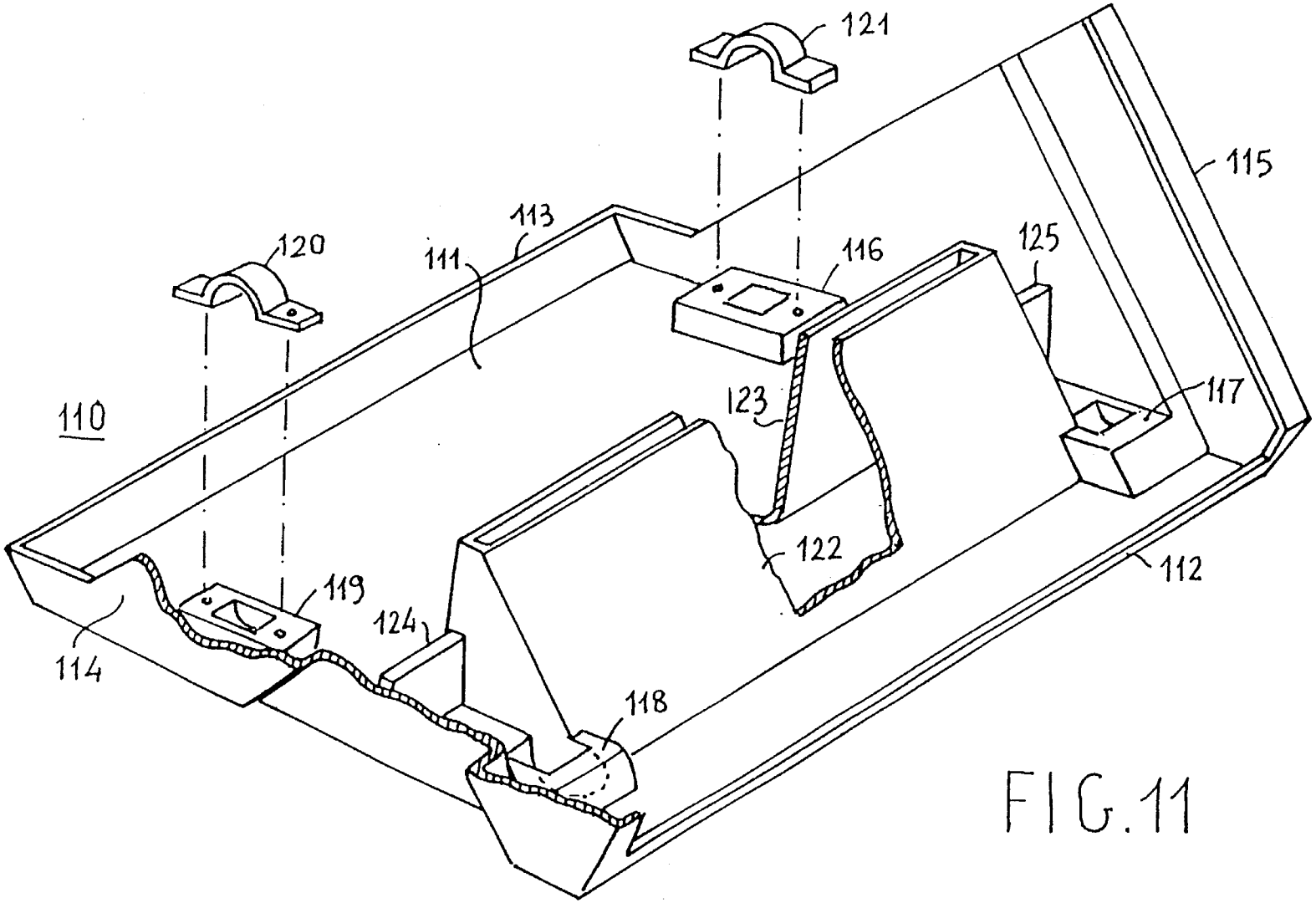
FIG. 11 shows in perspective view the base plate of the printer of FIG. 1.

FIG. 11 shows in perspective, partially in section view the base 110 of the printer with the objective of showing two specific features.

The base 110, preferably in reinforced plastic, is shaped as a rectangular tank formed by a plate 111 having a front rib 112, a rear rib 113 and two side plates 114, 115, substantially triangular in shape.

Adjacent to the side plates 114, 115 the plate 111 is provided with four risers 116,117,118, 199, each forming a housing for receiving one of the rubber resilient pads 56, 57, 58, 59 of the frame, and providing a coupling between the base plate and the frame.

Two of the risers, 116, 199 are provided with corresponding removable caps 120, 121, fixed by screws to the risers and providing steady confinement of the resilient pads in their housings.

The other two of the risers, each form a hock, which prevents removal of the pads from the housings, once all pads are properly inserted in their housings and the caps are set in fixing position.

Since the pads interposes between the side plates of the frame and the housing provided by the risers an effective damping is provided of vibrations induced by reciprocation of the print head along the printing line.

At the same time a steady resilient coupling is provided between frame and base plate which damps accelerations and shocks in the vertical direction.

Clearly the pads and the corresponding housings may have a shape different from the cylindrical one, for example a prismatic one.

A further original feature resides in the provision of a bottom hopper, formed by a front slanted plate 122 and a rear plate 123, extending upward from the base 111 to define an input slot for continuous forms fed from the bottom.

The front and rear plate 122,123 are coupled together at their ends close to side plates 110, 115 of the base plate. They are further coupled to the side plate by ribs 124, 125. Plates 123, 122 and ribs 124, 125 form a stiffening structure which renders virtually indeformable the base plate and increases its sturdiness.

Moreover, they form a separation wall between a front space where a tractor set may be housed and a rear space where the printer electronic is housed, thus preventing any possible access from the front to the rear and protecting the electronic circuits.

We claim:

1. A printer comprising:

a printer frame having two side plates and rods coupling said side plates, a front and a rear, a cabinet housing said printer frame and having a base plate, a front plate with an operator panel, a set of rear panels and two side faces, a print head carried by said printer frame and movable in the direction of said rods, a cylindrical rotating platen carried by said printer frame, motor means driving said platen, a removable tractor set releasably mounted in said printer frame, a gearing coupling said tractor set to said motor means for driving said tractor set in a predetermined paper advancement direction, first means for mounting said removable tractor set in a front position of said printer frame for advancing in push mode a continuous form to said platen from said front of said printer frame and said cabinet along a first paper path, second means for mounting said removable tractor set in a rear position of said printer frame, for advancing in push mode a continuous form to said platen from said set of rear panels along a second paper path, and pinch roller driving means, in said printer frame, coupled to said gearing and located between said print head and said first path for advancing a cut sheet to said platen from said front of said printer frame and said cabinet along a third paper path.

2. Printer as in claim 1, said cabinet having a dihedral recess in said front with apex parallel to the rotational axis of said platen, said dihedral recess being open at said side faces of said cabinet and providing access both to said tractor set, when mounted in said front position, both to said pinch roller driving means.

3. Printer as in claim 1, comprising a cut sheet supporting plate hinged to said cabinet at said dihedral apex, for pivotal movement between a first position in which said supporting plate is adjacent to an upper face of said dihedral recess and a second position in which said supporting plate is rotated apart from said upper face for supporting cut sheets manually inserted in said pinch roller driving means.

4. Printer as in claim 1, said removable tractor set comprising electrically controlled clutch means for decoupling said tractor set from said gearing and electrical connection means to said printer for controlling said clutch means by said printer.

5. Printer as in claim 1, said removable tractor set comprising a tractor supporting frame supporting a pair of tractors, a tractor driving shaft, a pair of extension mounting arms for mounting said tractor set to said printer frame, said mounting arms being pivotally mounted on said driving shaft and means for positioning said extension arms, relative to said tractor supporting frame, in one of two selectable positions.

6. Printer as in claim 1, said gearing comprising means for reversing the paper advancement direction of said tractor set, when mounted in said rear position of said printer frame.

7. Printer as in claim 1, comprising a first tractor set releasably mounted in said first position of said printer frame and a second tractor set releasably mounted in said rear position of said printer frame.

8. Printer as in claim 1, each of said side plates of said printer frame having at a lower edge a pair of resilient pads set aside of said side plates and extending beyond said lower edge, said cabinet base plate having recesses for partly housing said resilient pads and clamping means for clamping said resilient pads in said recesses, without contact of said side plates with said base plate.

9. A printer as in claim 1, said cabinet base plate having a bottom hopper formed therein by a raised front plate and a raised rear plate extending upward from said base plate, integral thereto and defining an input slot for continuous form bottom feeding through said base plate to said platen along a fourth paper path.

10. A printer as in claim 1, the set of rear plates of said cabinet being slanted and extending from said cabinet base plate upward to join with said cabinet front plate.

* * * * *